United States Patent [19]

Arimoto

[11] Patent Number: 4,459,447

[45] Date of Patent: Jul. 10, 1984

[54] SELF EXTINGUISHING TYPE GAS CIRCUIT BREAKER

[75] Inventor: Satomi Arimoto, Nishinomiya, Japan

[73] Assignee: Mitsubishi Denki Kabushiki Kaisha, Tokyo, Japan

[21] Appl. No.: 455,535

[22] Filed: Jan. 4, 1983

[30] Foreign Application Priority Data

Jan. 27, 1982 [JP] Japan ..... 57-11971
May 18, 1982 [JP] Japan ..... 57-85192

[51] Int. Cl.[3] ..... H01H 33/88
[52] U.S. Cl. ..... 200/148 A; 200/148 R
[58] Field of Search ..... 200/148 A, 148 R

[56] References Cited

U.S. PATENT DOCUMENTS

| | | | |
|---|---|---|---|
| 4,139,752 | 2/1979 | Itai et al. | 200/148 A |
| 4,182,942 | 1/1980 | Koyanagi et al. | 200/148 A |
| 4,228,332 | 10/1980 | Ibuki | 200/148 R |
| 4,270,034 | 5/1981 | Kii | 200/148 R |
| 4,381,436 | 4/1983 | Nagaoka et al. | 200/148 A |
| 4,383,152 | 5/1983 | Koppl et al. | 200/148 A |

OTHER PUBLICATIONS

1981 IEEE (81 WM 149-4), Self-Flow Generation Phenomena in a Gas Circuit Breaker Without Puffer Action, by Y. Ueda et al., 8 pages long.

1981 IEEE (81 WM 150-2), Self-Interruption by a Gas Circuit Breaker Without Puffer Action, by T. Ushio et al., 8 pages long.

1981 IEEE (81 SM 413-4), An Improvement of Low Current Interrupting Capability in Self-Interruption GCB, by Y. Murai et al., 5 pages long.

*Primary Examiner*—Robert S. Macon
*Attorney, Agent, or Firm*—Wenderoth, Lind & Ponack

[57] ABSTRACT

A self extinguishing type gas circuit breaker includes a body member having a first end connected to a terminal plate and a second end with a nozzle formed of electrical insulation material and defining a nozzle opening in communication with the interior of the body member. The interior of the body member includes an arcing chamber adjacent the nozzle and a gas storage chamber, such chambers being filled with an arc extinguishing gas. A stationary arc contact is electrcially connected to the terminal plate and is positioned within the body member at a location confronting the nozzle opening. A movable arc contact is mounted for movement through the nozzle opening between a circuit breaker closed position, whereat the movable arc contact extends through the nozzle into closed circuit contact with the stationary arc contact, and a circuit breaker open position, whereat the movable arc contact is spaced outwardly from the nozzle. Outward movement of the movable arc contact from the closed position to the open position during application of an arcing current between the stationary and movable arc contacts creates an arc. The energy of this arc increases the pressure of the arc extinguishing gas in the arcing chamber and then in the gas storage chamber. Partitions divide the gas storage chamber into a plurality of sub-chambers. A valve is positioned between the arcing chamber and at least some of the outlets of the sub-chambers and is mounted for movement away from the arcing chamber in response to the increase in pressure of the gas therein. The valve connects the arcing chamber with a number of the sub-chambers sufficient to ensure that, dependent on the relative level of the arcing current and the pressure in the arcing chamber, the pressure of the gas stored in such number of sub-chambers will achieve extinction of the arc.

11 Claims, 11 Drawing Figures

SELF EXTINGUISHING TYPE GAS CIRCUIT BREAKER

BACKGROUND OF THE INVENTION

The present invention relates to a self extinguishing type gas circuit breaker.

A known circuit breaker of this type is illustrated in FIGS. 1 to 3 of the drawings and includes a stationary terminal plate 1 on a power supply side and a load side terminal plate 10. A body member 2 has a first end fixed to the power supply side terminal plate 1, and at the opposite end of body member 2 is a nozzle 3 formed of insulating material and a stationary piston 4 formed of insulating material. A stationary arc contact 5 is fixed to terminal plate 1. A movable arc contact 6 is coupled to a driving mechanism (not shown) and is positioned to be movable thereby to be freely inserted into or withdrawn from stationary arc contact 5. A movable main contact 7 is made of an electrically conductive material and is fixed to movable arc contact 6. A power supply side stationary main contact 8 is fixed at one end thereof to the power supply side terminal plate 1 and is adapted at the other end thereof to be in sliding contact with movable main contact 7, such that current may be conducted therebetween. A load side stationary main contact 9 has one end thereof fixed to load side terminal plate 10 and the other end thereof in contact with movable main contact 7. Within the load side terminal plate 10 is a bearing 12 which supports a rod 11 which is fixed to movable arc contact 6 and which connects movable arc contact 6 and movable main contact 7 with each other. Within the interior of body member 2 is a gas storage chamber 13 containing an arc extinguishing fluid such as $SF_6$ gas. A suction chamber 14 is defined by elements 7, 4 and 3. Nozzle 3 has a conical guide opening 15, through which communication between chambers 13 and 14 is achieved when contacts 6 and 7 have been moved to a position such that contact 6 is separated from contact 5. When contacts 6 and 7 have been fully opened to an arc extinguishing position, a gas passage 16 is formed to communicate the interior of suction chamber 14 with an exterior container (not shown) filled with the arc extinguishing fluid, i.e. $SF_6$ gas or the like (see FIG. 3). Such exterior container for example might be a container surrounding the apparatus shown in FIGS. 1–3 and being filled with the arc extinguishing fluid. Communication between storage chamber 13 and such exterior container is achieved by a slot 17 formed in terminal plate 1. Similarly, holes 19 in terminal plate 10 provide communication of such exterior container with a chamber 18 defined by elements 7, 9 and 10. Upon use of the apparatus shown in FIGS. 1–3, an arc 20 is formed in an arcing chamber 21. The power supply side stationary main contact 8 and the load side stationary main contact 9 are coaxial and generally are concentric with terminal plates 1 and 10 and body member 2. The rod 11 which connects movable arc contact 6 and movable main contact 7 is in the form of a shaft which is coupled to the driving mechanism (not shown) and is journaled in bearing 12.

The operation of this known circuit breaker now will be described. FIG. 1 illustrates the circuit breaker in a circuit breaker closed position. Current might flow from the power supply side terminal plate 1 through the power supply side stationary main contact 8, the movable main contact 7 and the load side stationary main contact 9 to the load side terminal plate 10. A part of the current is shunted along a path which extends from the power supply side terminal plate 1 through the stationary arc contact 5, the movable arc contact 6, the movable main contact 7, and the load side stationary main contact 9 to the load side terminal plate 10.

When an arc is to be formed, a release command is given to the driving mechanism (not shown), and the movable arc contact 6 and movable main contact 7 begin to move in the direction of arrow a as indicated in FIG. 2, and such movement is by a predetermined wiping stroke. By this movement, the movable main contact 7 first is separated from the stationary main contact 8, such that all of the current then flows through element 1, 5, 6, 7, 9 and 10. Subsequently, the movable arc contact 6 is separated from the stationary arc contact 5 after a predetermined period of time, and the electric arc 20 is formed between contacts 5 and 6 in arcing chamber 21 (see FIG. 2). At this time, the movable cylindrical main contact 7 moves leftwardly as viewed in FIG. 2 in sliding contact with stationary piston 4 formed of insulating material. This contact separating motion thus increases the volume of suction chamber 14 and lowers the fluid pressure therein. The formation of arc 20 releases thermal energy which increases the temperature and pressure of the arc extinguishing fluid in arcing chamber 21, and this increased temperature and pressure fluid flows backward into gas storage chamber 13, as indicated by arrows b and b′ (this phenomenon is referred to as "arc back"), and such increased temperature and pressure fluid mixes with the arc extinguishing fluid at a low temperature contained in gas storage chamber 13. Thus, the pressure of the arc extinguishing fluid in gas storage chamber 13 increases, so that movable arc contact 6 moves still further. In this case, as illustrated in FIG. 3, when the movable arc contact 6 has passed through the guide opening 15 in the forward end part of the insulating nozzle 3, the gas storage chamber 13 and the suction chamber 14 will be in communication with each other through the opening 15 and arcing chamber 21. At such time, the arc extinguishing fluid in the gas storage chamber 13 is blown out against the arc 20, as indicated by arrows c and c′, and flows into suction chamber 14 through the arcing chamber 21 and the opening 15. As indicated by arrows $d_1$ and $d_1'$ part of the arc extinguishing fluid is discharged into the exterior fluid container (not shown) via slot 17 provided in power supply side terminal plate 1. As the arc extinguishing fluid from the gas storage chamber 13 flows into the suction chamber 14, such fluid cools the arc 20 in the opening 15, such that the arc is extinguished and the current between contacts 5 and 6 is interrupted. Since, when the circuit breaker is in the condition illustrated in FIG. 3, the pressure of suction chamber 14 has increased, the arc extinguishing fluid in suction chamber 14 is discharged through passage 16 into the exterior container, as indicated by arrows e and e′. Thus, the condition of insulation between the stationary arc contact 5 and the movable arc contact 6 is maintained, and interruption of the arc is completed.

The above description is of the operation of the circuit breaker of FIGS. 1–3 under high current conditions. There now will be described the manner of interruption of the arc under conditions where the current flowing between the terminal plates 1 and 10 is of low or medium value. As illustrated in FIG. 3, when the movement of the movable main contact 7 has increased the volume of the suction chamber 14 and lowered the fluid pressure therein, the fluid of low temperature and high insulating property flows from the exterior fluid container via slot 17 into suction chamber 14 while crossing the arc 20, as indicated by the dotted arrow lines $d_2$ and $d_2'$. This is due to the fact that the thermal energy generated by the arc is not sufficient to increase the pressure in chamber 13 to a level required to cause passage of fluid from chamber 13 through slot 17, as indicated by arrows $d_1$ and $d_1'$. When the arc extinguishing fluid crosses the arc 20 in opening 15, the arc 20 is cooled and the thermal energy thereof is absorbed, such that the current is interrupted at a zero current point. The pressure of the suction chamber 14 rises due to the absorption of the thermal energy of the arc 20, whereby the fluid is discharged through passage 16 into the exterior container as indicated by arrows e and e'. Thus, the condition of insulation between the stationary arc contact 5 and the movable arc contact 6 is maintained, and interruption of the arcing current of low or medium value is completed.

However, in this known arrangement illustrated in FIGS. 1-3, the volume of the gas storage 13 is designed to achieve extinguishing of the arc under high arcing current values. However, when low or medium current values are employed for arcing, the resultant thermal energy of the arc 20 is such that the pressure rise in chamber 13 is insufficient to achieve interruption of the arc current and to extinguish the arc. In this known arrangement, in order to ensure forced arc extinction, it is necessary to provide suction in chamber 14 which communicates with chamber 13 through opening 15. This makes it possible to create a situation whereby, even with a relatively low level of pressure increase in chamber 13, there is generated a pressure difference between suction chamber 14 and gas storage chamber 13 and the exterior fluid container. This requires an operating force which is the product of the pressure difference and the sectional area of the cylinder defining the suction chamber. For example, in order to generate a pressure difference of two atmospheres in the case of a cylinder having a diameter of 140 mm, an operating force of $$\frac{14^2 \times \pi}{4} \times 2\text{ kg} \approx 300\text{ kg}$$

becomes necessary. Since the suction chamber 14 and opening 15 come into communication, the temperature rises due to the thermal energy of arc 20 and the inflow of fluid blown from gas storage chamber 13 against arc 20, and the arc extinguishing fluid containing an electrically conductive gas are drawn into suction chamber 14. As a result, the temperature and pressure in suction chamber 14 rise, and the insulating condition is lowered.

SUMMARY OF THE INVENTION

With the above discussion in mind, it is an object of the present invention to provide an improved self extinguishing type gas circuit breaker whereby it is possible to overcome the disadvantages of known such circuit breakers.

It is a more specific object of the present invention to provide such a circuit breaker which avoids the need for the provision of a suction chamber to provide a forced extinguishing function under conditions of low and medium arcing current levels.

It is a further object of the present invention to provide such a circuit breaker which automatically is operable dependent on the relative level of the arcing current to ensure self extinguishing of the arc.

These objects are achieved in accordance with the present invention by the provision of a body member having a first end fixedly connected to a terminal plate and a second end. A nozzle formed of electrical insulation material is connected to the second end of the body member and defines a nozzle opening communicating with the interior of the body member. The interior of the body member includes an arcing chamber adjacent the nozzle and the gas storage chamber, such chambers being filled with an arc extinguishing gas. A stationary arc contact is electrically connected to the terminal plate and is positioned within the body member at a location confronting the nozzle opening. A movable arc contact is mounted for movement through the nozzle opening between a circuit breaker closed position, whereat the movable arc contact extends through the nozzle into closed circuit contact with the stationary arc contact, and a circuit breaker open position, whereat the movable arc contact is spaced outwardly from the nozzle. The movable arc contact is moved from the closed position to the open position during application of an arcing current between the stationary and movable arc contacts, thereby enabling the formation therebetween of an arc. Such arc generates energy causing an increase in pressure of the arc extinguishing gas in the arcing chamber and then in the gas storage chamber. Upon the interruption of the arcing current, the pressurized gas from the gas storage chamber is discharged therefrom through the nozzle opening to extinguish the arc. The pressure of the pressurized gas discharged from the gas storage chamber is regulated as a function of the arcing current to ensure that the pressurized gas is at a pressure sufficient to achieve extinction of the arc. Partitions divide the gas storage chamber into a plurality of sub-chambers, each sub-chamber having an outlet communicating with the arcing chamber. A valve is positioned between the arcing chamber and at least some of the outlets of the sub-chambers and is mounted for movement away from the arcing chamber in response to the increase in pressure of the gas therein. The valve connects the arcing chamber with a number of the sub-chambers sufficient to ensure that, dependent upon the relative level of the arcing current and the pressure in the arcing chamber, the pressure of the gas stored in such number of sub-chambers will achieve extinction of the arc. The gas in the arcing chamber, having the temperature and pressure thereof increased by the thermal energy of the arc, flows back into such number of sub-chambers and mixes with the fluid therein, thus resulting in a gas mixture having a sufficiently low temperature and a sufficiently high pressure to achieve extinction of the arc, as a function of the current level employed for forming the arc.

In accordance with a further feature of the present invention, the valve is maintained at the operative position thereof spaced from the arcing chamber for a predetermined period of time until the arc is extinguished, and then the valve is returned to the original position thereof.

BRIEF DESCRIPTION OF THE DRAWINGS

Other objects, features and advantages of the present invention will be described in more detail below, with reference to the accompanying drawings, wherein.

DETAILED DESCRIPTION OF THE INVENTION

Figure 1:
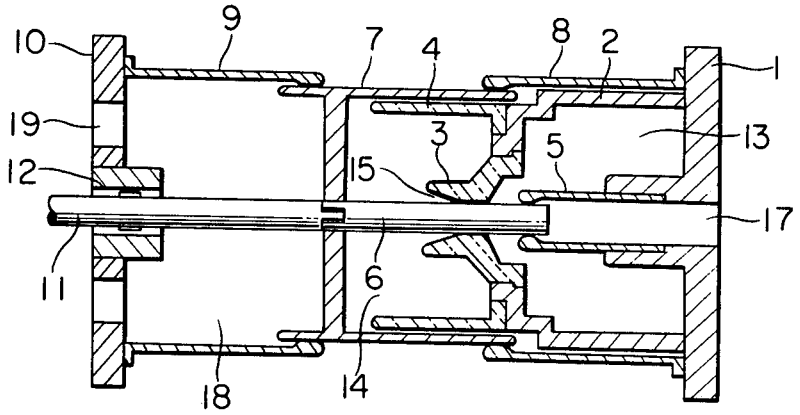
FIG. 1 PRIOR ART
FIG. 1 is an elevation view, partially in section, of a known self extinguishing type gas circuit breaker shown in the closed circuit position thereof.

Before proceeding with a detailed description of the various specific embodiments of the present invention, attention is directed to the fact that throughout the various figures of the drawings, the same or similar reference numerals are employed to designate the same or similar elements.

Figure 2:
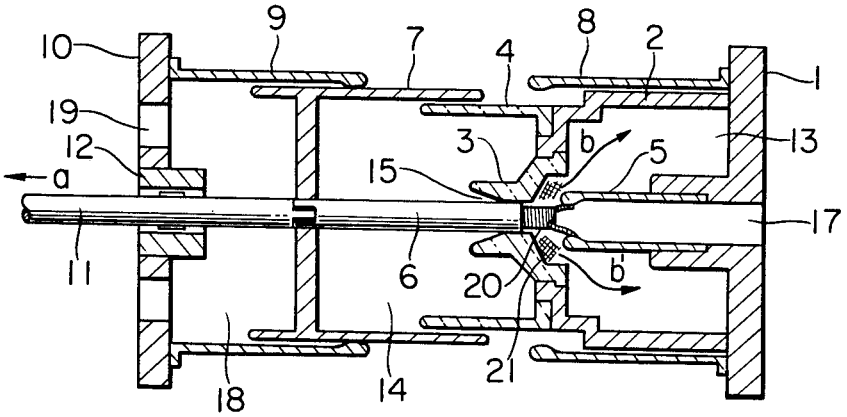
FIG. 2 is a view similar to FIG. 1, but showing the circuit breaker in the arc forming position thereof.
Figure 3:
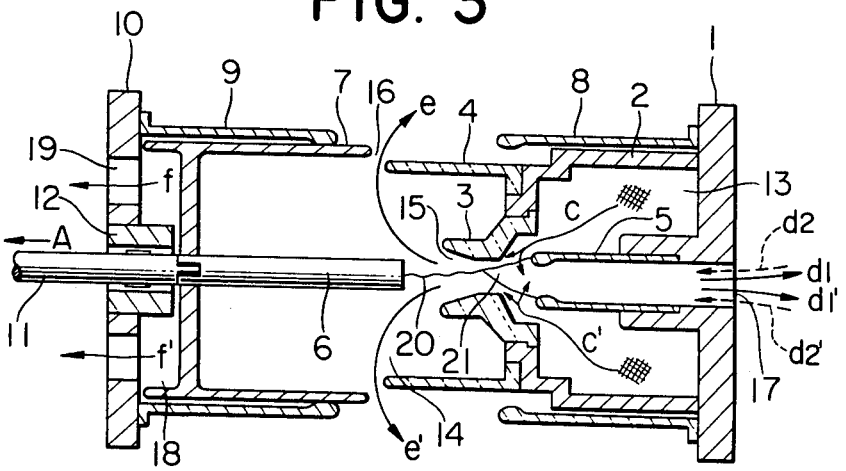
FIG. 3 is a view similar to FIG. 1, but showing the known circuit breaker thereof in an arc extinguishing position.
Figure 4:
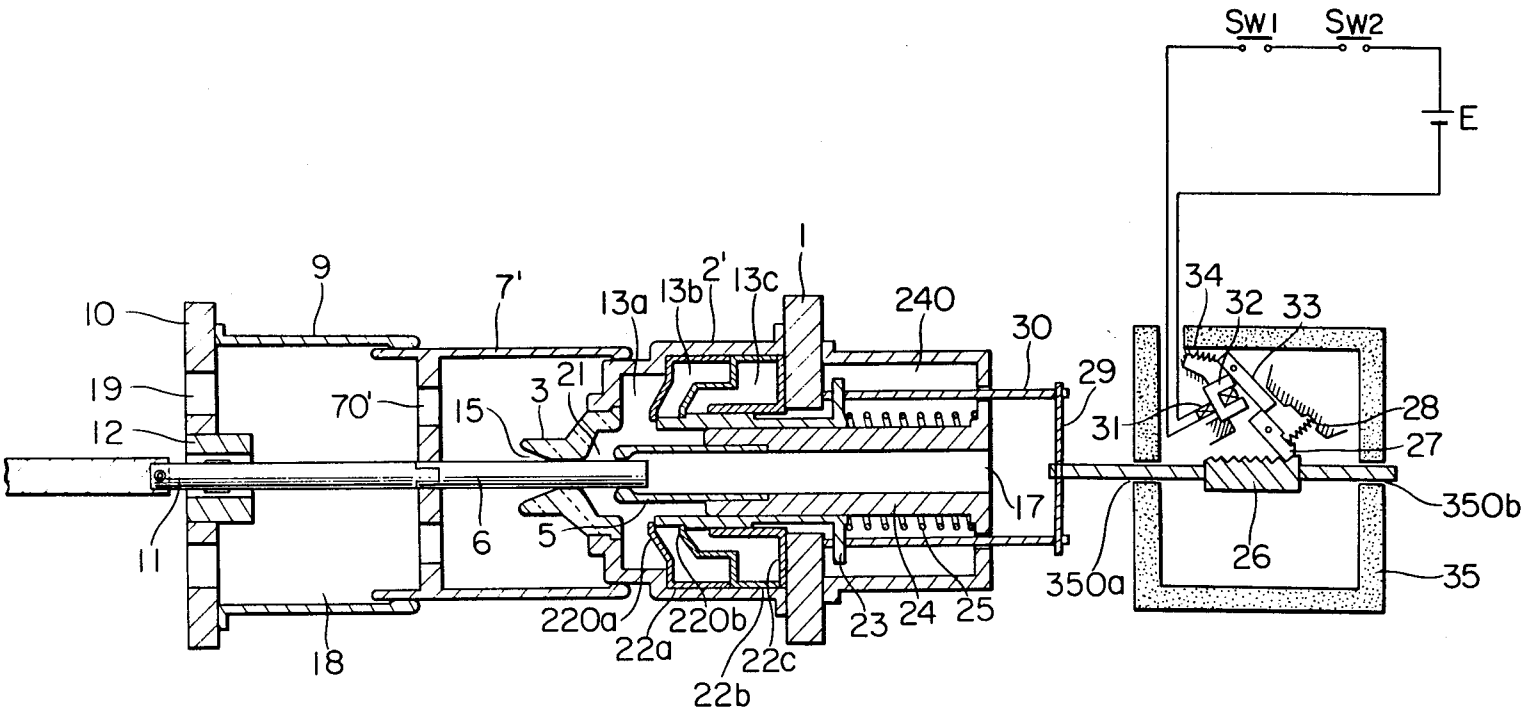
FIG. 4 is an elevation view, partially in section, of a self extinguishing type gas circuit breaker according to one embodiment of the present invention, shown in the closed position thereof.
Figure 5:
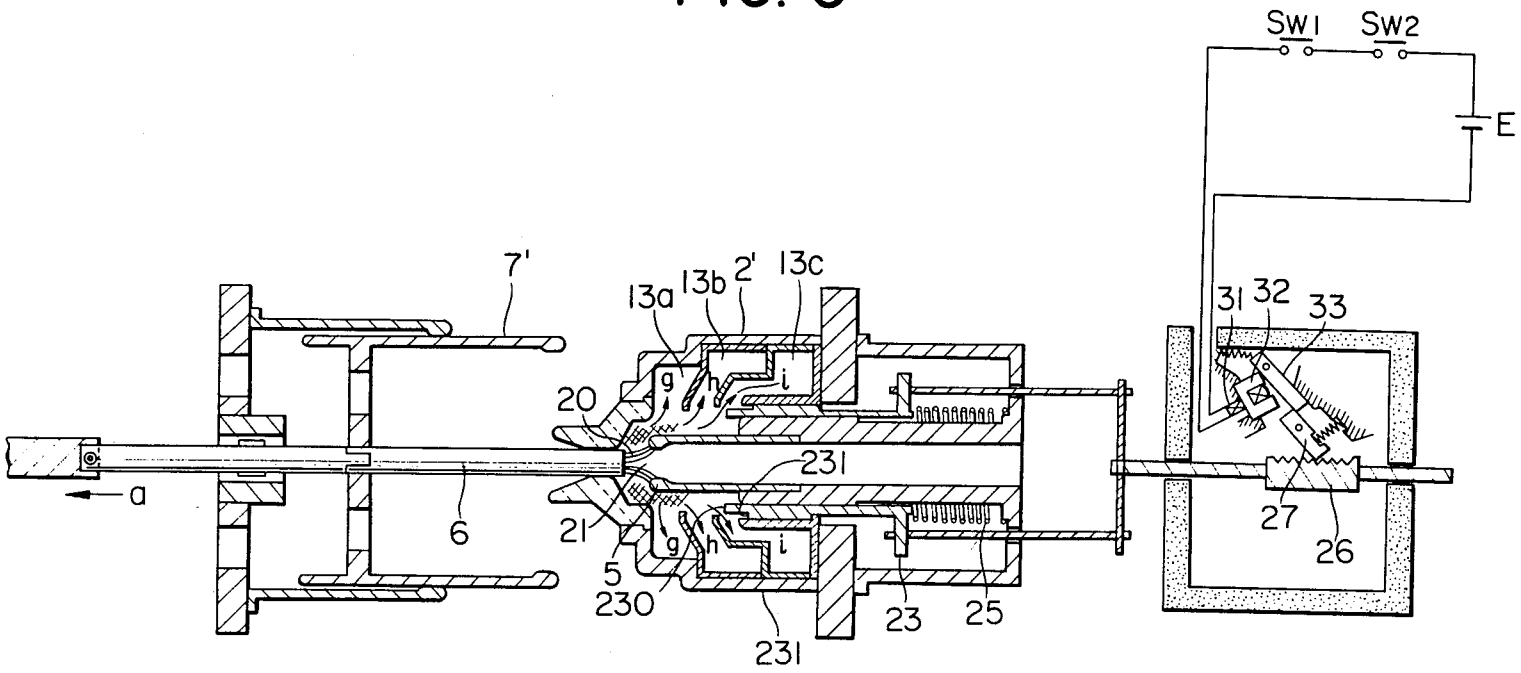
FIG. 5 is a view similar to FIG. 1, but showing the circuit breaker in the arc forming position.
Figure 6:
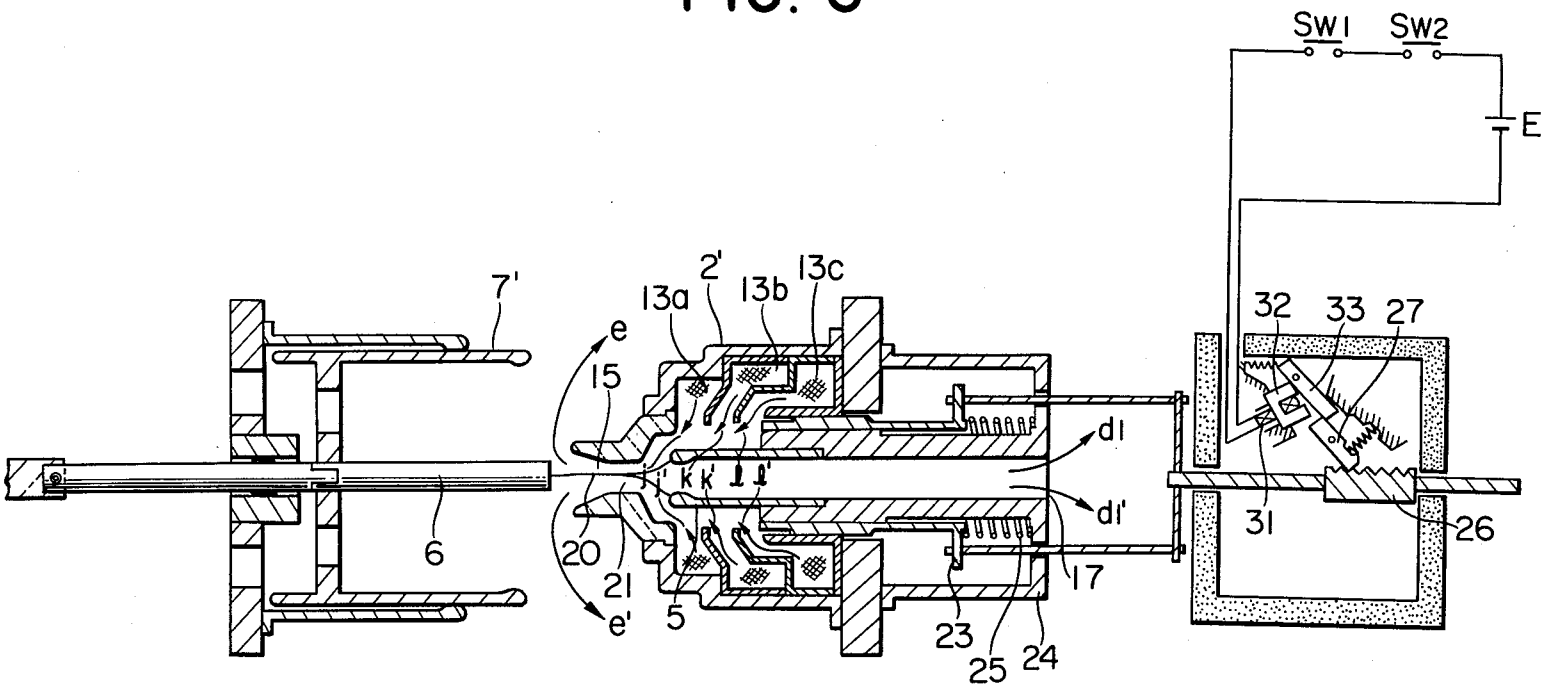
FIG. 6 is a view similar to FIG. 4, but showing the circuit breaker in the arc extinguishing position.

A first embodiment of the invention is illustrated in FIGS. 4–6, and many of the elements thereof are similar to the elements described above regarding the known circuit breaker of FIGS. 1–3, and accordingly the same reference numerals are employed. A current conducting movable main contact 7′ is connected to a rod 11 and may be formed by, on the power supply side thereof, a plurality of annularly arranged finger contacts. Contact 7′ has therein one or more holes 70′ for the passage therethrough of fluid. An outer body member 2′ is fixed to supply side terminal plate 1 and is formed of an electrically conductive material. Body member 2′ thus serves as a power supply side stationary contact which is contacted by movable means contact 7′ during the closed position of the circuit breaker, as shown in FIG. 4. The interior of body member 2′, rather than defining a single gas storage chamber as in the prior art circuit breaker of FIGS. 1–3, is partitioned into a plurality of sub-chambers, for example three sub-chambers 13*a*, 13*b*, 13*c* as shown in the drawings. Specifically, inner body members 22*a*, 22*b* and 22*c* are mounted within outer body member 2′ to define the sub-chambers, each of which has an outlet communicating with arcing chamber 21.

A pressure-responsive valve 23, for example of cylindrical configuration, is positioned between arcing chamber 21 and at least some of the outlets of the sub-chambers and is mounted for movement away from arcing chamber 21 in response to an increase of pressure therein upon the generation therein of arc 20. Thus, the greater the pressure of the fluid in arcing chamber 21, the greater will be the distance which valve 23 moves away from the arcing chamber. Thus, the greater the pressure in arcing chamber 21, dependent upon the arcing current, the more outlets of the sub-chambers 13*a*, 13*b*, 13*c* will be opened successively by movement of the valve 23. A supporting tube 24 supports valve 23 and also has attached thereto stationary arc contact 5. Current flows from power supply side terminal plate 1 through support tube 24 to the stationary arc contact 5. A spring chamber 240 receives a return spring 25 which normally urges valve 23 toward the arcing chamber to the original position thereof shown in FIG. 4 and whereat stopper portions 220*a*, 220*b* of inner body members 22*a*, 22*b*, respectively, abut with and stop further movement of valve 23.

Valve 23 is coupled, for example by means of insulating rods 30 and coupling disc 29, to a latch element 26, for example having thereon a rack as illustrated in the drawings. A cog or ratchet 27 is pivotally mounted and is biased by return spring 28 into engagement with latch 26. A releasing or unlocking device for releasing of engagement of ratchet 27 with latch 26 includes a magnet coil 31, a stationary core 32, a movable core 33 and a return spring 34. Upon actuation of magnet coil 31, movable core 33 is attracted to stationary core 32, thereby pivoting ratchet 27 against the force of spring 28 out of engagement with latch 26. This enables spring 25 to return valve 23 to the original position shown in FIG. 4. Accordingly, when valve 23 is moved away from arcing chamber 21, return movement of the valve initially is prevented by the latching arrangement, for reasons to be discussed in more detail below. The latching arrangement is surrounded by an insulating casing 35 having therethrough 350*a*, 350*b* for supporting latch 26. A timed electrical signal causes operation of the unlocking device to enable return movement of valve 23. Coil 31 is part of an electrical circuit including a power source E and switches $SW_1$ and $SW_2$ which are interlocked with the operation of the circuit breaker.

The operation of the embodiment of FIGS. 4–6 now will be described.

In the circuit breaker closed position, the main contacts and the arc contacts are held in engagement, as illustrated in FIG. 4. Current thus flows from supply side terminal plate 1 to load side terminal plate 10 via stationary main contact 2′ (also serving as the outer body member), current conducting movable main contact 7′ and stationary main contact 9. Additionally, a part of the current flows from the power supply side terminal plate 1 to the load side terminal plate 10 via supporting tube 24, stationary arc contact 5, movable arc contact 6, current conducting movable main contact 7′ and stationary main contact 9. Valve 23 is urged to its original position by spring 25, such that the outlets of sub-chambers 13*b* and 13*c* of the gas storage area are not in communication with arcing chamber 21, and only sub-chamber 13*a* is in communication with arcing chamber 21.

The operation of forming arc now will be described with reference to FIG. 5. The driving mechanism (not shown) is given a releasing command, whereupon the movable arc contact 6 begins to move in the direction of arrow a and moves a predetermined wiping stroke. Accordingly, the movable main contact 7′ is disengaged from stationary main contact 2′, such that all current flows through element 24 and the arcing contacts. Subsequently, movable arc contact 6 is disengaged from stationary arc contact 5 after a predetermined period of time, and electric arc 20 is generated across the arc contacts. Arc 20 emits thermal energy into the arcing chamber 21, and the temperature and pressure of the arc extinguishing fluid therein is increased. Such arc extinguishing fluid flows backward into sub-chamber 13*a* as indicated by arrows g (this phenomenon being termed "arc back"), and such fluid mixes with the arc extinguishing fluid of low temperature and pressure existing in sub-chamber 13*a*. As a result, the pressure of the arc extinguishing fluid in sub-chamber 13*a* increases. When the thermal energy of arc 20 is great, that is when the interrupting current is great, the pressure in sub-chamber 13*a* increases substantially. End face 230 of valve 23 is acted on by this pressure in an amount proportional to the area of end face 230, and thus valve 23 moves against the force of spring 25 in a direction opposite to arrow a. Accordingly, the opening to sub-chamber 13*b* is unblocked, and sub-chamber 13*b* then is in communication with arcing chamber 21 and sub-chamber 13*a*. As a result, the arc extinguishing fluids in chambers 13*a* and 13*b* mix, thereby to result in arc extinguishing fluid of a sufficiently high pressure and sufficiently low temperature to extinguish the arc. During movement of valve 23 away from arc extinguishing chamber 21, ratchet 27 engages in latch 26, thereby preventing return movement of valve 23 upon a decrease of the pressure acting thereon. Thus, at a point at which the current decreases toward the zero point, with the result that the pressure acting on valve 23 is reduced, valve 23 is prevented from returning in the direction of arrow a to its original position.

Accordingly, in the arc extinguishing position shown in FIG. 6, the arc extinguishing fluids, at increased pressure, are blown toward the arc 20 as indicated by arrows j, j', k, k' in FIG. 6, and extinguish the arc.

When the interrupting current equals the rated short circuit current of the circuit breaker, i.e. when the current increases even further, the thermal energy of arc 20 will be greater. This will result in even greater pressure in the arcing chamber and in sub-chambers 13*a*, 13*b*. These pressures acting on end faces 230 and 231 of valve 23 cause even further movement of valve 23 against the force of spring 25, thereby unblocking the outlet of sub-chamber 13*c*. As a result, the increased pressure gases will pass into sub-chamber 13*c*, as indicated by arrows i in FIG. 5. The result will be the provision of an arc extinguishing fluid sufficiently high in pressure and low in temperature to interrupt the rated short circuit current. Upon this further movement of valve 23 away from arcing chamber 21, return movement of valve 23 again will be prevented by ratchet 27 engaging latch 26. When the current decreases toward the zero point, the arc extinguishing fluid in chambers 13*a*, 13*b*, 13*c* is blown toward the arc 20, as indicated by all of the arrows j, j', k, k', l, l' in FIG. 6. This fluid extinguishes the arc and passes through arcing chamber 21 and opening 15 and into an exterior fluid container (not shown), for example a container surrounding the structure illustrated in FIGS. 4–6, as indicated by arrows e, e' in FIG. 6. Another part of the arc extinguishing fluid is discharged into such exterior container via slot 17 provided in supporting tube 24, as indicated by arrows $d_1$, $d_1'$.

Latch 26 and ratchet 27 prevent return movement of valve 23 for a sufficient time period to ensure that all of the increased pressure gas in chambers 13*a*, 13*b*, 13*c* has been discharged to extinguish the arc. At a predetermined time in relation to the completion of the separation of the contacts, contacts $SW_1$ and $SW_2$ of the switches which interlock with the operation of the circuit breaker are closed. Accordingly, magnet coil 31 is energized to attract movable core 33 to stationary core 32, thereby pivoting ratchet 27 against the force of spring 28 out of engagement with latch 26. This enables spring 25 to return valve 23 to the original position after the arc is extinguished, whereafter the contacts may be brought into the original condition illustrated in FIG. 4.

In accordance with the present invention, the circuit breaker is provided with the capability of interrupting arcs generated by a wide range of current values, and not only a large current value equal to the short circuit current, but also a medium current value of a load current or a small current value such as the exciting current of a transformer, the charging current of a capacitor, etc. The self-extinction according to the principal of the present invention is achieved by successful interruption of currents of all such values and provides an advantage over known such circuit breakers.

An important feature of a self extinguishing circuit breaker is that, in mixing an arc extinguishing fluid of high temperature based on the heat emitted by an arc and an arc extinguishing fluid of low temperature in a gas storage chamber, a more satisfactory arc extinguishing performance is achieved by varying the volume of the gas storage chamber as a function of the magnitude of the current to be interrupted. In the prior art circuit breaker structure shown in FIGS. 1–3, the volume of the gas storage chamber 13 is constant, and therefore at medium or low current values the pressure of the arc extinguishing fluid in chamber 13 often is insufficient to achieve forced extinction of the arc. To attempt to overcome this disadvantage, it is necessary to provide a pressure difference between chamber 13 and a suction chamber 14, but this requires a substantial operating force. Also, the temperature within suction chamber 14 is increased due to the communication of chamber 14 with opening 15, and as a result the insulating condition is reduced.

However, in accordance with the present invention, it is not necessary to provide suction chamber 14 to generate a sufficient negative pressure therein to enable forced extinction. Furthermore, the insulating stationary piston 4 which is necessary in the known arrangement of FIGS. 1–3 is unnecessary according to the present invention. Therefore, high temperature gas, the electrical conductivity of which thus is increased, is discharged promptly into the exterior surrounding container without being maintained in the area around the contacts. This will be apparent by a comparison of arrows e, e' in FIGS. 3 and 6. Accordingly, it is possible to achieve very satisfactory interrupting characteristics with no flash over across the arc contacts.

Figure 7:
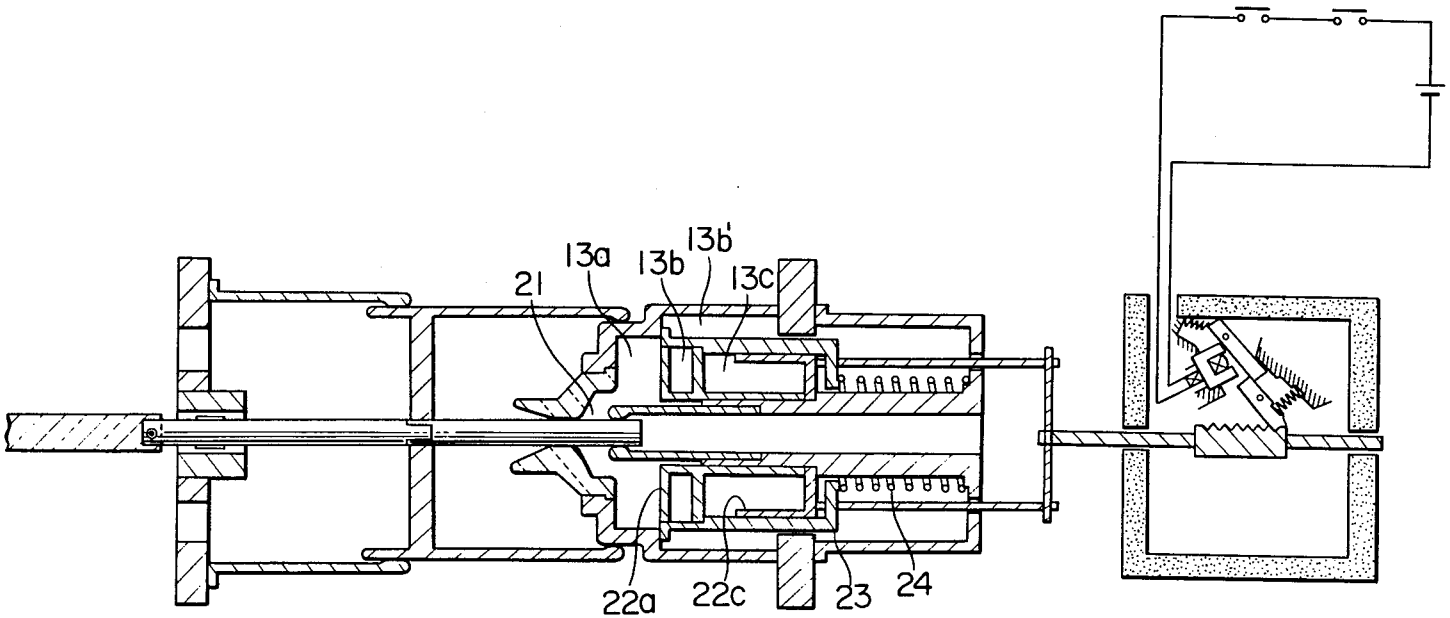
FIG. 7 is a view similar to FIG. 4, but illustrating a modification of this embodiment.

FIG. 7 shows a modification of the embodiment of FIGS. 4–6. In the arrangement of FIG. 7, to avoid potential problems due to the amount of the heat from the arc, the outlets of the sub-chambers are spaced further from the arcing chamber 21. Thus, inner body members 22*a*, 22*c* are positioned radially inwardly of valve 23, rather than in the reverse arrangement in the embodiment of FIGS. 4–6. The device of the modification of FIG. 7 otherwise operates in the manner of the embodiment of FIGS. 4–6, as described above.

Figure 8:
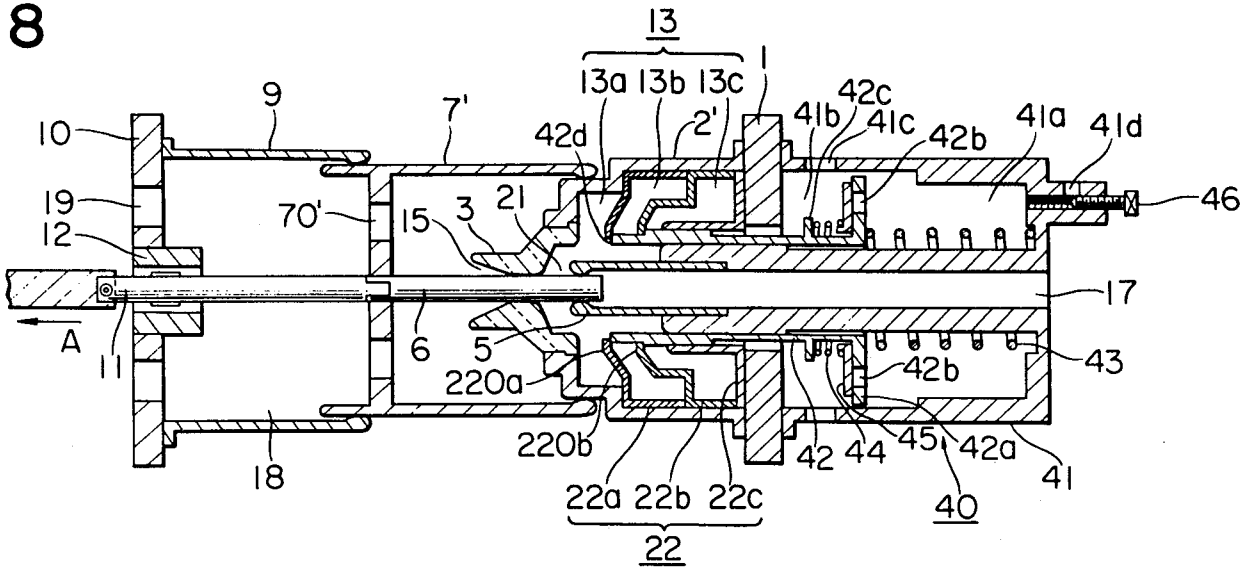
FIG. 8 is an elevation view, partially in section, of a self extinguishing type gas circuit breaker according to another embodiment of the present invention, shown in the closed position thereof.
Figure 9:
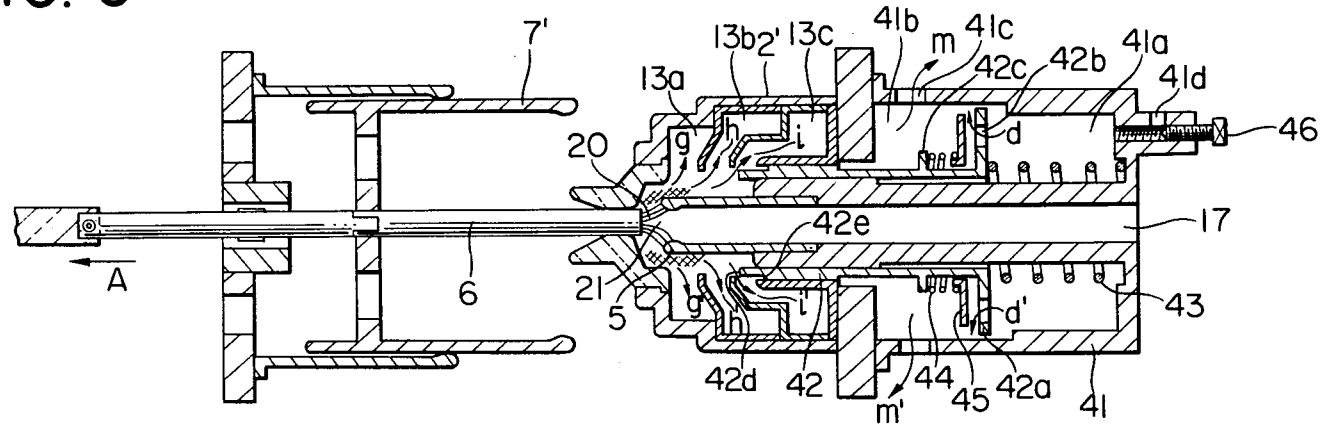
FIG. 9 is a view similar to FIG. 8, but showing the circuit breaker in the arc forming position.
Figure 10:
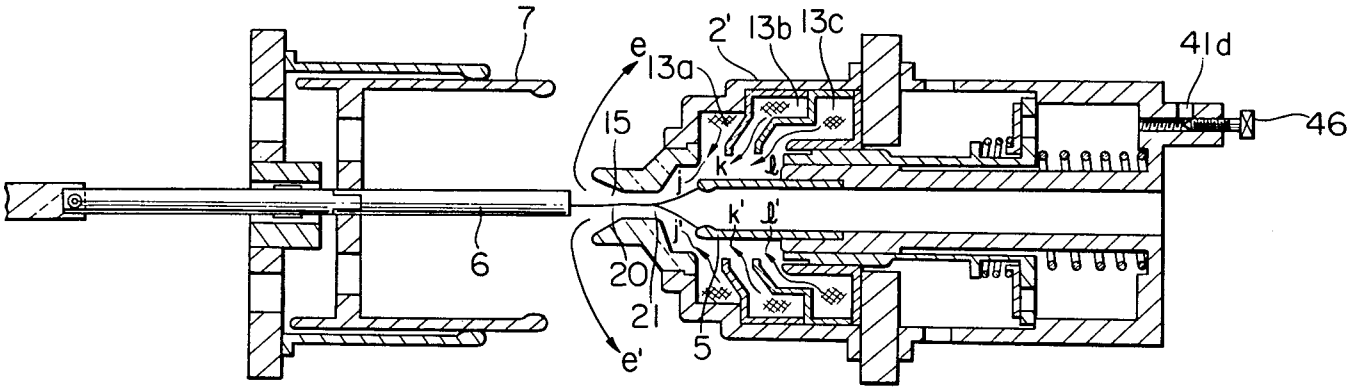
FIG. 10 is a view similar to FIG. 8, but showing the circuit breaker in the arc extinguishing position.

With reference now to FIGS. 8–10, there will be described an embodiment of the present invention which provides for delayed return of the valve 23 without the provision of the latching or locking arrangement of FIGS. 4–6. Thus, in FIGS. 8–10, there is provided a cylinder 41, the outer wall of which is fixed to the power supply side terminal plate 1. A valve 42 performs the function of valve 23 of the embodiment of FIGS. 4–6 and is supported in a manner to be slidable on an inner wall of the cylinder 41. The stationary arc contact 5 is secured to the front end of the inner wall of cylinder 41, and cylinder 41 also serves to supply current from terminal plate 1 to stationary arc contact 5. The interior of cylinder 41 is provided with an annular cylinder chamber which forms a dash-pot device 40 to provide for delayed return movement of valve 42. A piston portion 42*a* of valve 42 divides the interior of cylinder 41 into first and second chambers 41*a* and 41*b*. Although in the drawings the outer periphery of cylinder portion 42*a* is shown as spaced from the inner wall surface of cylinder 41, in actuality piston portion 42*a* is in substantial sealing sliding contact with such inner wall surface. A spring 43 is retained between piston portion 42*a* and a rear wall of the cylinder 41 and tends to urge valve 42 to its original position. Holes 42*b* are formed in piston portion 42*a*. An annular valve or plate 45 is positioned adjacent holes 42*b* on the chamber 41*b* side thereof and is urged against piston portion 42*a* to close holes 42*b* by means of a spring 44 retained between plate 45 and a stopper 42*c* formed on valve 42. Outlet ports 41*c* are formed in cylinder 41 to provide communication from chamber 41*b* to an exterior fluid filled container (not shown). Similarly, an inlet port 41*d* provides communication from such exterior container to chamber 41*a*. An adjustably positioned valve, such as needle valve 46 threaded into a boss on cylinder 41, adjustably blocks more or less the inlet port 41*d*, thereby regulating the extent of communication from the exterior container into chamber 41*a*.

The manner of operation of the embodiment of FIGS. 8–9 now will be described.

The manner of application of current, formation of the arc and extinction of the arc by the various positions of engagement and disengagement of the respective contacts is achieved in the manner described above regarding the embodiment of FIGS. 4–6. Thus, the following discussion will be of the manner of the operation of valve 42 and the delayed return thereof after extinction of the arc.

FIG. 8 shows the circuit breaker closed position, and this is similar to the above discussion regarding FIG. 4. Upon the formation of an arc and the increased pressure of the arc extinguishing fluid in arcing chamber 41, valve 42 is moved in a direction opposite to arrow A by a distance which is a function of such increased pressure. Specifically, the front end face of valve 42 is acted on by a pressure in proportion to the area of such front end face 42*d*, and various or all of sub-chambers 13*a*, 13*b*, 13*c* are opened, all in the manner described above regarding the embodiment of FIGS. 4–6. As a result of this movement however, the internal pressure of chamber 41*a* of cylinder 41 is increased due to the reduction in volume thereof by movement of piston portion 42*a*. Due to this pressure increase, the fluid in chamber 41*a* pushes valve plate 45 away from piston portion 42*a*, and such fluid flows through holes 42*b* into chamber 41*b*, as indicated by arrows d, d′ in FIG. 9. Thus, the pressure in chambers 41*a* and 41*b* are substantially equalized. Thus, there is no pressure difference between these two chambers acting against the force of spring 43, and spring 43 is opposed only by the pressure acting on the end face of valve 42.

However, upon the current decreasing toward the zero point value, i.e. during extinction of the arc, the pressure acting on end faces 42*d* and 42*e* of valve 42 decreases, and the force of spring 43 overcomes such pressures tending to move valve 43 in the direction of arrow A. After only a slight such movement however, there is caused an increase in the volume of chamber 41*a*, with the result that the pressure therein decreases. Thereby, there is achieved a pressure difference between chambers 41*a* and 41*b* sufficient to maintain valve plate 45 in a position to close holes 42*b*, under the force of spring 44. Also, this pressure difference is sufficient to overcome the return force spring 43, and thus valve 42 is prevented from returning in the direction of arrow A. However, the fluid in chamber 41*b* passes through exit ports 41*c* into the exterior container, as indicated by arrows m, m′ in FIG. 9, and also fluid passes from such external container through throttled inlet port 41*d* into chamber 41*a*. However, regulating device 46 throttles the passage of fluid into chamber 41*a* such that the equalization of pressures between chambers 41*a* and 41*b* occurs gradually over a delayed period of time which is adjustable by member 46. As a result, valve 42 gradually moves in the direction of arrow A, and valve 42 is prevented from immediately returning in such direction until the increased pressure gases in the various sub-chambers have been blown out to ensure extinction of the arc. At such time as the pressures in chambers 41*a* and 41*b* are equalized, spring 43 returns valve 42 to its original position, and then the various contacts may be returned to their initial positions illustrated in FIG. 8. The time of the delay of the return of valve 42 can be adjusted in a manner such that the inflow/outflow of the arc extinguishing fluid between the exterior container and chamber 41*a* is regulated by element 46.

Since the delayed operation device 40 of this embodiment of the present invention is constructed and operated as described above, valve 42 moves to open the various sub-chambers to ensure that a predetermined amount of arc extinguishing fluid is blown out to affect self extinction of the arc. Also, valve 42 is returned automatically to the original position after the lapse of a predetermined time interval which readily is adjustable. Thus, this delayed operation device 40 performs substantially the same function as the locking and releasing devices of the embodiment of FIGS. 4–6. However, the structure of the embodiment of the present invention is substantially simplified and it is not necessary to provide a timer control for providing locking and releasing command signals. Thus, both the structure and the control of the self extinguishing type gas circuit breaker of this embodiment is simplified.

Figure 11:
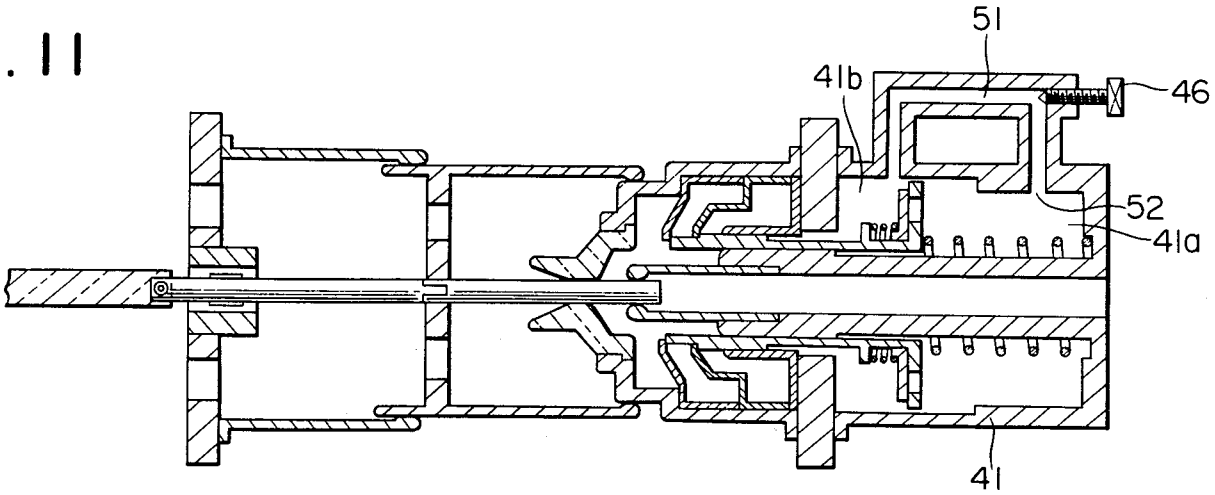
FIG. 11 is a view similar to FIG. 8, but showing a modification of this embodiment.

FIG. 11 illustrates a modification of the embodiment of FIGS. 8–9. Thus, the communication of the fluid from chamber 41*b* to 41*a* in accordance with this embodiment is provided by a bypass passage 51 extending from chamber 41*b* to an inlet 52 in chamber 41*a*. A regulating element 46 similar to that of the embodiment of FIGS. 8–10 is provided in the bypass passage 51 to more or less block or unblock bypass passage 51. This modification provides the advantage that dust which may be produced by the wear of metal elements, insulators, etc. is prevented from entering the chambers 41*a*, 41*b*. In all other respects, the modification of FIG. 11 operates in the manner described above regarding the embodiment of FIGS. 8–10.

It is to be understood that the sub-chamber structure of FIG. 7 may be employed in the embodiments of FIGS. 8–11.

Furthermore, while in the embodiments described above, the circuit breaker of the present invention has been described and illustrated with respect to three sub-chambers, it is intended that the present invention include a circuit breaker having only two sub-chambers or circuit breakers having more than three sub-chambers.

Although the present invention has been described and illustrated with regard to particularly preferred embodiments thereof, it is to be understood that various modifications and changes may be made to the specifically described and illustrated structural arrangements, as would be apparent to one of ordinary skill in the art, without departing from the scope of the present invention.

I claim:

1. A self extinguishing type gas circuit breaker comprising:

a body member having a first end fixedly connected to a terminal plate and a second end;

a nozzle formed of electrical insulation material connected to said second end of said body member and defining a nozzle opening communicating with the interior of said body member;

said interior of said body member including an arcing chamber adjacent said nozzle and a gas storage chamber, said chamber being filled with an arc extinguishing gas;

a stationary arc contact electrically connected to said terminal plate and positioned within said body member at a location confronting said nozzle opening;

a movable arc contact mounted for movement through said nozzle opening between a circuit breaker closed position, whereat said movable arc contact extends through said nozzle into closed circuit contact with said stationary arc contact, and a circuit breaker open position, whereat said movable arc contact is spaced outwardly from said nozzle;

operating means for moving said movable arc contact from said closed position to said open position during application of an arcing current between said stationary and movable arc contacts, thereby enabling the formation of an arc therebetween, whereby said arc generates energy causing an increase in pressure of said arc extinguishing gas in said arcing chamber and then in said gas storage chamber, and whereby upon the interruption of said arcing current the pressurized gas from said gas storage chamber is discharged therefrom through said nozzle opening to extinguish said arc; and means for regulating the pressure of said pressurized gas discharged from said gas storage chamber as a function of said arcing current to ensure that said pressurized gas is at a pressure sufficient to achieve extinction of said arc, said regulating means comprising partitions dividing said gas storage chamber into a plurality of sub-chambers, each said sub-chamber having an outlet communicating with said arcing chamber, and valve means, positioned between said arcing chamber and at least some of said outlets of said sub-chambers and mounted for movement away from said arcing chamber in response to said increase in pressure of said gas therein, for connecting said arcing chamber with a number of sub-chambers sufficient to ensure that, dependent on the relative level of said arcing current and said pressure in said arcing chamber, the pressure of said gas stored in said number of sub-chambers will achieve extinction of said arc.

2. A circuit breaker as claimed in claim 1, further comprising means for maintaining said valve means at the operative position thereof away from said arcing chamber and connecting said arcing chamber with said number of sub-chambers for a period of time until said arc is extinguished, and then for returning said valve means to the original position thereof.

3. A circuit breaker as claimed in claim 2, wherein said maintaining and returning means comprises latch means for holding said valve means at said operative position thereof, unlocking means for releasing said latch means when said arc is extinguished, and return means for urging said valve means to said original position thereof.

4. A circuit breaker as claimed in claim 3, wherein said latch means comprises a rack connected to and movable with said valve means and a ratchet mounted for engagement with said rack, said unlocking means comprises means for moving said ratchet out of engagement with said rack, and said return means comprises a spring biasing said valve means toward said arcing chamber.

5. A circuit breaker as claimed in claim 2, wherein said maintaining and returning means comprises a fixedly positioned cylinder, a piston connected to said valve means and movable therewith in said cylinder, said piston dividing the interior of said cylinder into first and second fluid-containing chambers, said piston having therein aperture means for enabling passage therethrough of fluid from said first chamber to said second chamber upon movement of said valve means away from said original position thereof, a cover member for normally closing said aperture means and operable to open said aperture means only during movement of said valve means away from said original position thereof, means for urging said piston and said valve member to return to said original position thereof, whereby upon the removal of pressurized gas from said arcing chamber said urging means tends to return said piston and said valve means to said original position thereof, thereby creating between said first and second chambers a pressure difference overcoming the force of said urging means, means for enabling fluid from said second chamber to pass to said first chamber, thereby balancing the pressures therein, and adjustable means for delaying the introduction of said fluid from said second chamber into said first chamber, thereby for the delayed balancing of pressures in said first and second chambers, whereafter said urging means acts on said piston to return said valve means to said original position thereof.

6. A circuit breaker as claimed in claim 5, wherein said enabling means comprises an outlet port in said cylinder for providing fluid communication from said second chamber into a fluid filled container adapted to be positioned exterior of said cylinder, and an inlet port in said cylinder for providing fluid communication from the fluid filled container into said first chamber.

7. A circuit breaker as claimed in claim 6, wherein said adjustable means comprises a valve member adjustably mounted in said cylinder for partially blocking said inlet port.

8. A circuit breaker as claimed in claim 5, wherein said enabling means comprises a bypass passage extending from said second chamber to said first chamber.

9. A circuit breaker as claimed in claim 8, wherein said adjustable means comprises a valve member adjustably mounted for partially blocking said bypass passage.

10. A circuit breaker as claimed in claim 1, wherein said at least some of said outlets of said sub-chambers face generally radially inwardly, and said valve means is mounted for movement at a location radially inwardly of said partitions.

11. A circuit breaker as claimed in claim 1, wherein said at least some outlets of said sub-chambers face generally radially outwardly, and said valve means is mounted for movement at a location radially outwardly of said partitions.

* * * * *